United States Patent [19]

Smialek

[11] Patent Number: 4,939,873

[45] Date of Patent: Jul. 10, 1990

[54] SKI GRINDING DEVICE

[76] Inventor: Edward B. Smialek, 2053 W. 13th Pl., Cleveland, Ohio 44113

[21] Appl. No.: 301,169

[22] Filed: Jan. 24, 1989

[51] Int. Cl.[5] ..... B24B 41/00; B24B 41/06

[52] U.S. Cl. ..... 51/281 R; 269/906; 269/204; 76/83; 51/217 R; 51/217 P; 51/228

[58] Field of Search ..... 76/83 R; 269/906, 130, 269/131, 265, 267, 254 CS, 203, 204; 51/281 R, 217 R, 217 P, 228

[56] References Cited

U.S. PATENT DOCUMENTS

| | | | |
|---|---|---|---|
| 3,608,885 | 9/1971 | Roth | 269/906 |
| 3,778,048 | 12/1973 | Szohatsky | 269/906 |
| 4,341,375 | 7/1982 | Romanin | 269/906 |
| 4,589,640 | 5/1986 | Pert | 269/203 |
| 4,804,433 | 2/1989 | Smith | 269/254 CS |

FOREIGN PATENT DOCUMENTS

| | | | |
|---|---|---|---|
| 2164596 | 6/1973 | Fed. Rep. of Germany | 51/228 |

*Primary Examiner*—Frederick R. Schmidt
*Assistant Examiner*—Jack W. Lavinder
*Attorney, Agent, or Firm*—Fay, Sharpe, Beall, Fagan, Minnich & McKee

[57] ABSTRACT

A ski grinding device and method comprising a holder having an adjustably sizable frame and a plurality of biasing legs disposed to engage the ski and maintain it in a flattened position. By holding the ski flat, the running surface can be ground more controllably and precisely.

14 Claims, 8 Drawing Sheets

SKI GRINDING DEVICE

BACKGROUND OF THE INVENTION

This application pertains to the art of ski grinding, and more particularly to a holding device for a snow ski for improved ski grinding. The invention is particularly applicable to be used with an automatic ski grinding machine and will be described with particular reference thereto. However, it will be appreciated that the invention has broader applications and could be used with a hand grinding device or advantageously employed in other environments and applications.

After a ski has been in use for a certain amount of time the bottom runner and the edges of the ski acquire gouges, scrapes, and nicks which damage the integrity of the ski. Such gouges, scrapes and nicks on the bottom runner of the ski destroy the smoothness of the bottom. The bottom should be smooth to allow for a more frictional-less contact between the snow and the runner thereby allowing greater speed and more responsive control. Additionally, damage to the edges of the ski diminishes the responsiveness of the ski when a skier attempts to make turns and stops.

In order to regain the integrity of the ski by recreating a smooth bottom surface and removing the nicks and scrapes from the edges of the ski, skiers will typically have these sections of the ski ground and sharpened to acquire the desired smoothness on the bottom of the ski and the sharpness on the edges.

A typical present method for grinding of skis employs a stone grinder with a foot pedal and a drive wheel so that the weighted drive wheel drags the ski across the stone. An alternative method for sharpening is simply having a grinding stone and a person who is grinding to hold the ski in his or her hands and by eyesight re-sharpen the ski's edges.

When using a stone grinder with a drive wheel to drag the ski across the stone, the drive wheel must make contact with the ski. Direct contact to the top of the ski is not desirable due to the damage the drive wheel would cause to the bindings which are located on the top portion of the ski. Therefore, some sort of holding device must be employed to allow the drive wheel to move the ski without directly touching the ski.

Heretofore various methods have been implemented in an attempt to allow the drive wheel to move the ski absent directly contacting the ski. One method includes putting a ramp-type frame on top of the ski so that the area underneath the ramp includes the ski bindings. This allows the drive wheel to move the ski and at the same time avoid damaging the bindings.

A major drawback to this type of method is that the cross-feed of the ski is not constant. The cross-feed is the rate at which the ski is pulled from its front portion or tip through the grinding machine until it reaches its end portion or tail. Excessive grinding occurs when the drive wheel is moving up and down the ramp, as it takes more time to cover the horizontal area beneath the ramp than the horizontal areas not beneath the ramp because the drive wheel simple has to go farther while going up and down the ramp than the grinding wheel has to go across the opposed flat ski surface. This excessive grinding creates scallops in these areas, thereby destroying the complete smoothness of the ski.

The problem with a non-constant cross-feed has been addressed by another method. This method includes using a straight edge in a parallel feed system. The operator of the grinder simply lays a straight edge on a ski and holds the ski and straight edge together when feeding the ski into the machine. Such a method eliminates scallops caused by inconsistent cross-feeds. While cross-feed is controlled by the rate that the feeder wheel pulls the ski through the grinder, in-feed of a ski is controlled by weighing the drive wheel onto the ski. In-feed is the amount of material that is removed by bringing the wheel to the ski or ski to the wheel and is usually controlled by weight and not by a specific amount. In other words, by applying a selected weight to the wheel, the resulting pressure will cause some amount of the ski surface to be removed. Since the straight edge is in no way hooked or fastened to the ski and the ski itself is not straightened out, problems with in feed control will persist.

Specifically, since weight controls the in-feed to the grinding wheel and the width of the ski changes from tip to tail, the amount of in-feed will vary with the width of the ski, thus varying in-feed. By not being positively attached to the ski, the straight edge or ramp mechanism will have a tendency to chatter and slide thereby causing non-uniformed pressure from the drive wheel to be transferred down to the ski.

Additionally, each ski contains an inherent camber to its form and such camber is destroyed or altered when either of the above-mentioned holding methods are used since neither of the methods completely flatten or decamber the ski to be ground. The present methods are simply concerned with making the ski flat from edge to edge. No consideration is given to making the ski smooth from edge tip to edge tail.

Consequently, a need exists for improvements in the holding of a ski to be reground which will result in greater reliability in control of cross-feed, in-feed, and decambering of a ski's normal structure thereby allowing a ski to be refinished with the ski bottom being smooth edge to edge and tip to tail and for accurate sharpening of ski's edges, while at the same time maintaining the original camber of the ski.

SUMMARY OF THE INVENTION

The present invention provides a ski holding apparatus and method designed to satisfy the aforementioned needs. Holding of the ski is carried out by a fixture device which fixes a flattened ski in order for the ski to be ground in a grinding machine. The ski consists of a front section designated a tip section, a rear section designated a tail section, and a bottom surface known as a running surface. The ski is straightened and a registered surface created by putting the ski on a true straight edge and clamping it to that straight edge. Thereafter, an adjustable frame which is selectively sizeable is mounted onto the ski. The frame is mounted by attaching a flexible material from the frame to the tip section and then attaching the tail section of the ski to the frame by positioning the frame by the tail and selectively altering the size of the frame member to create a compression on the ski. When the appropriate size of adjustable frame has been chosen, the frame itself is locked through a frame locking means.

After the frame has been attached biasing legs extending from the frame apply pressure to the top of the ski. Each of the legs may be individually adjusted to increase or decrease the pressure being placed on the ski top. After such adjustments have been made the front section legs are locked through the use of a locking lever. An additional individual leg located in the back section of the fixture is individually locked.

After the necessary attachments and adjustments have been made the ski is released from the true straight edge and is appropriately held for grinding.

A first advantage of the present invention is a consistent control of the in-feed and cross-feed of the ski from edge to edge and tip to tail of the ski all along its running surface thereby allowing a level refinishing of the entire bottom of the ski.

Another advantage of the present invention is that by maintaining the ski rigidly in place accurate bevelling of the ski sides may be accomplished.

Yet another advantage of the present invention is that by decambering the ski before grinding, the natural camber of the ski may be maintained thereby avoiding alterations in the flex pattern of the ski.

Still yet another advantage of the present invention is to allow the operator of the grinding machine to automatically feed in the ski without the necessity of the operator maintaining the frame manually in connection with the ski.

Still further advantages of the present invention will become apparent to those of ordinary skill in the art upon reading and understanding the following detailed description of the preferred and alternative embodiments.

BRIEF DESCRIPTION OF THE DRAWINGS

The present invention may take form in various parts and arrangements of parts or in various steps and arrangements of steps. The drawings are only for purposes of illustrating preferred embodiments and are not to be construed as limiting the invention.

DETAILED DESCRIPTION OF THE PREFERRED EMBODIMENT

The drawings are for purposes of illustrating the preferred embodiment of the invention only, and not for the purposes of limiting same.

Figure 1:
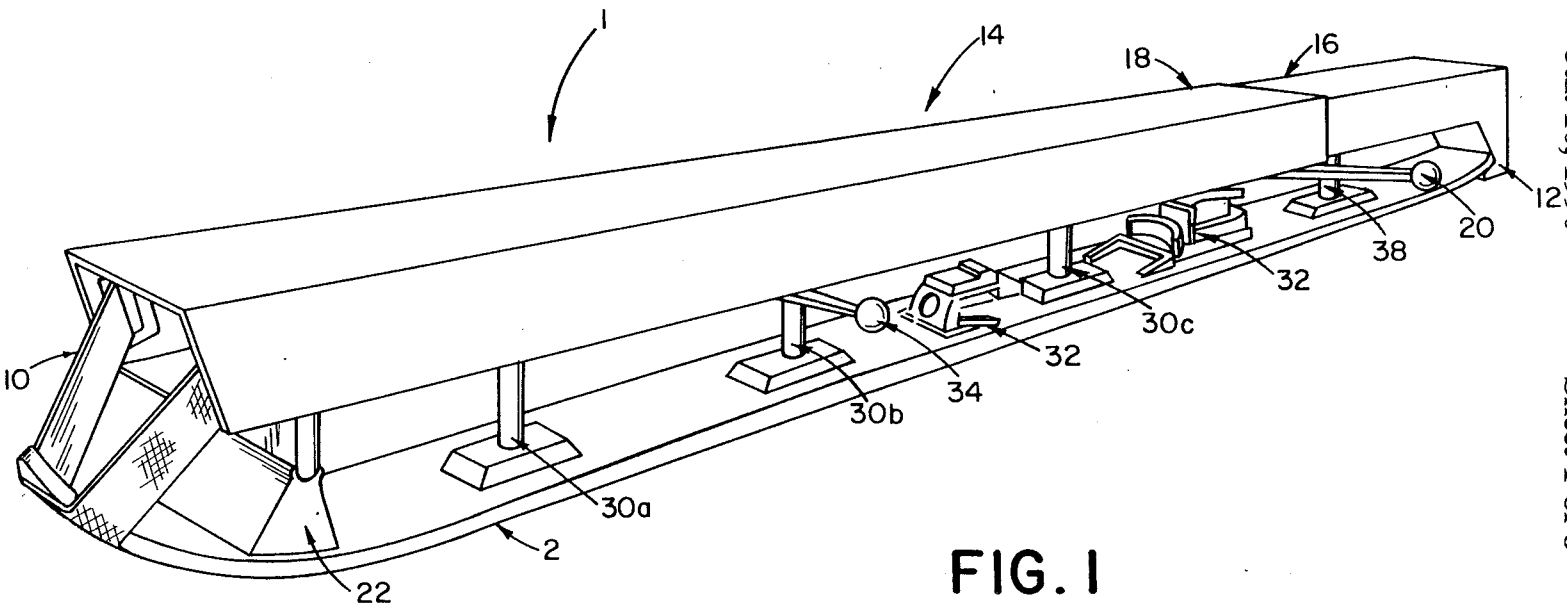
FIG. 1 is a diagrammatical illustration of the fixture device attached to a ski.
Figure 9:
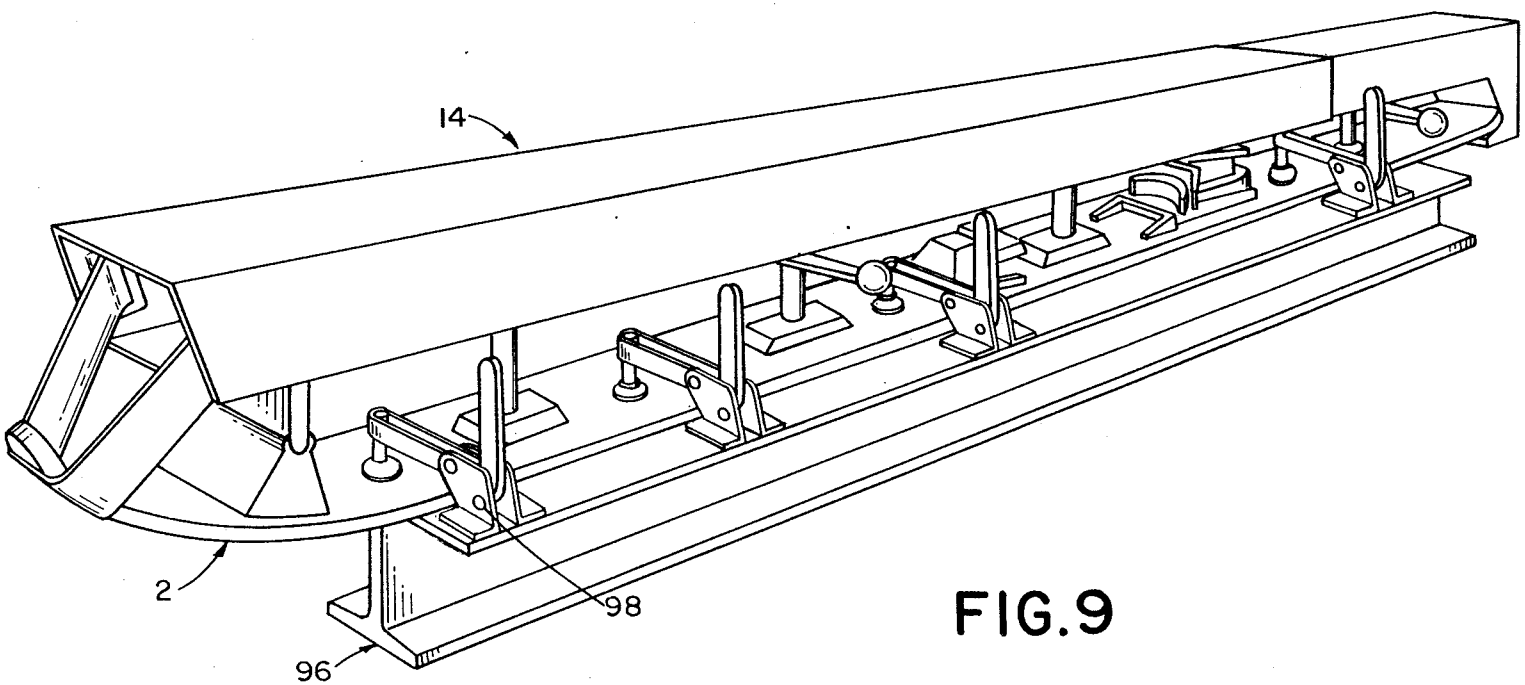

With reference to FIG. 1, a ski holding device 1 is shown attached to a straightened ski 2. The ski is straightened by pressing it against a true edge (FIG. 9). The front portion or tip of the ski 2 is attached to the ski holding device 1 by a flexible strap 10 found at the front of the ski holding device 1 and looped around the tip of the ski. The end or tail of the ski is held in place by a rigid holding section 12 of the ski holding device 1. The rigid holding section 12 is placed behind the tail of ski and the selectively adjustable frame 14 is lengthened or shortened by sliding the inner section 16 of the frame either in or out of the outer section 18 of the frame. The frame member 14 is preferably prefabricated lightweight metallic material. After the frame has been adjusted to apply compression to the ski by tightly holding the ski to the frame, frame lock 20 is locked to maintain the frame in the selected position as will be further discussed below.

At the front portion of the ski holding device 1 located directly behind the flexible strapping 10 is a non-adjustable support 22 used to support the curvature found at the transition area between the flat surface of the ski and the curved tip. The non-adjustable support 22 extends across the width of the ski. It may be made of a light plastic material with an anti-skid type bottom and a hollow interior.

Extending from the underside of the frame outer portion 18 and engaging the top of the ski are several biasing legs **30*a*, 30*b*, and 30*c* disposed at intervals to bias the ski in a flattened position. It is to be appreciated that the biasing legs 30*a*–30*c* are spring loaded, and though not shown in FIG. 1, a biasing leg could engage the ski on top of part or all of the bindings 32**.

After the biasing legs **30*a*–30*c* have been positioned and adjusted, a biasing leg locking lever 34 is actuated to thereby fix the position of legs 30*a*–30*c***.

Located on the inner-section 16 of the selectably sizable adjustable frame member 14 is an independent biasing leg 38 which extends from the underside of the frame member 16 and engages the top of the ski in order to bias the ski in a flattened position. The individual biasing leg 38 is thereafter locked into position.

The biasing legs **30*a*–30*c*, 38** are spring loaded to allow an up/down adjustment relative to the ski.

Figure 2:
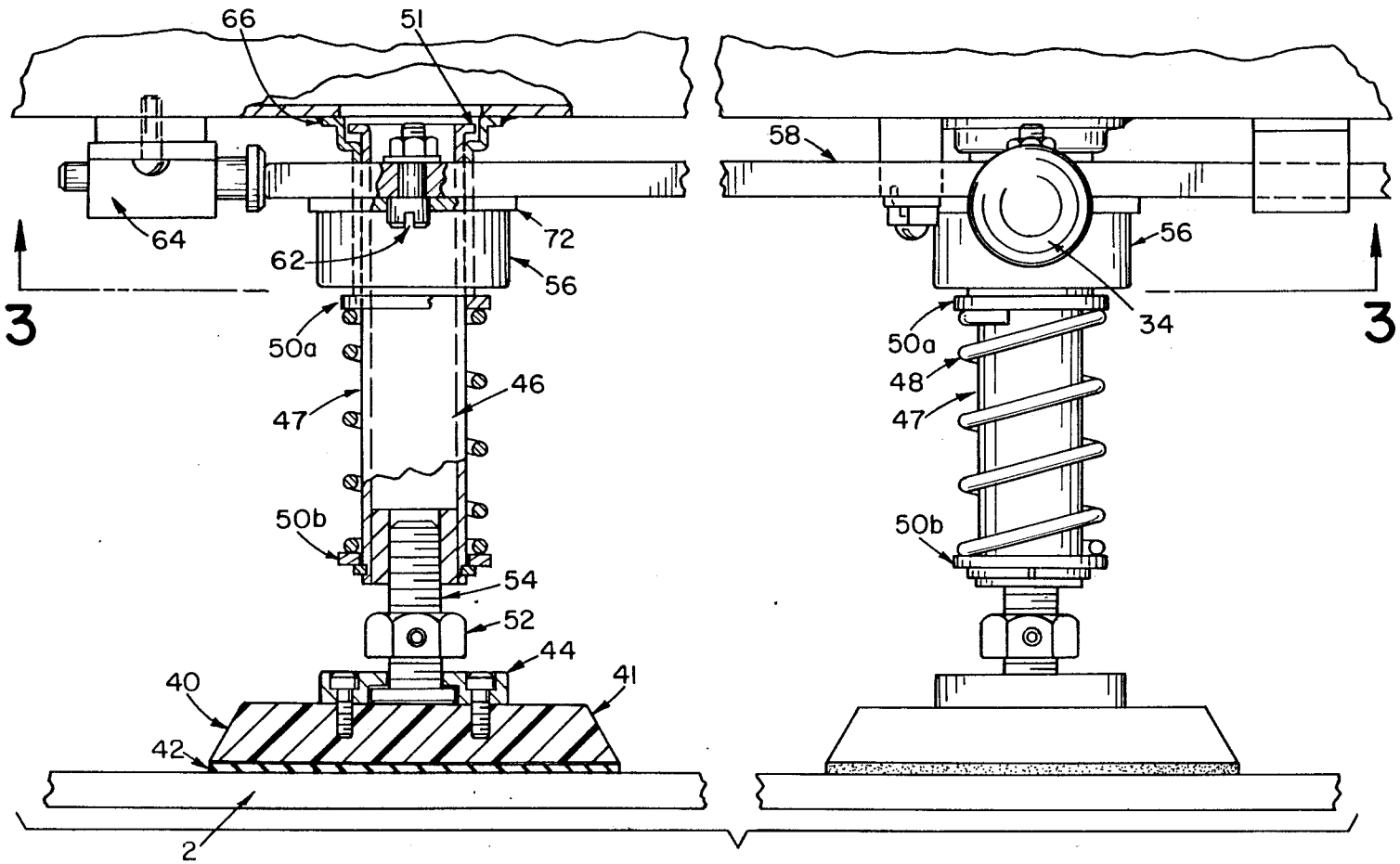
FIG. 2 is a cut-away drawing and elevated view of the biasing legs.

With particular reference to FIG. 2, a cut-away of one of the biasing legs. The biasing legs **30*a*–30*c*, 38 include head 40 which impinges upon the ski 2. The head comprises a frusto-conical body portion 41 and an anti-skid pad 42 to maintain a desired position on the ski. The head 40 is connected to the post portion 46 of the leg through the use of a conventional fastener device 44**.

The post 46 of the leg is encircled by a biasing spring 48 which applies a downward force to the head 40 for biasing the head against the ski to assist in holding the ski. It should be noted that the downward pressure caused by the spring may be altered by the choice of spring. The spring is maintained on the post 46 by two retainer rings **50*a* and 50*b***.

After the biasing legs **30*a*–30*c*, 38 have been positioned onto the ski 2, adjustment of the amount of pressure applied to the top of the ski may be made by turning the adjustment nut 52 up or down the adjustment stud 54. Wherein the adjustment stud 54 and the adjustment nut 52 which is threadedly received in the post 46** are simply a nut and bolt configuration.

The means for locking the front outer portion biasing legs **30*a*–30*c* is an eccentric twist grip 56. The three forward biasing legs 30*a*–30*c* are commonly connected through an actuator bar 58 for simultaneous locking. Upon actuation of the biasing legs lock lever 34 the three eccentric twist grips 56 are activated thereby causing simultaneous locking of all three biasing leg means 30*a*–30*c*. A fine adjustment to the eccentric twist grip lock 56 is provided by screw 62, thereby allowing an operator to adjust for any inequalities in the locking strength among the three legs. A spring 64 creates a degree of tension in the axial movement of the actuator bar 58**.

Post 46 is telescopically received in a sleeve 47 which is fixed to the frame member 14 at junction 66 through some sort of conventional attaching means, possibly spot-welding. The stroke of the post 46 in the sleeve 47 is defined by a spacing 51.

Figure 3:
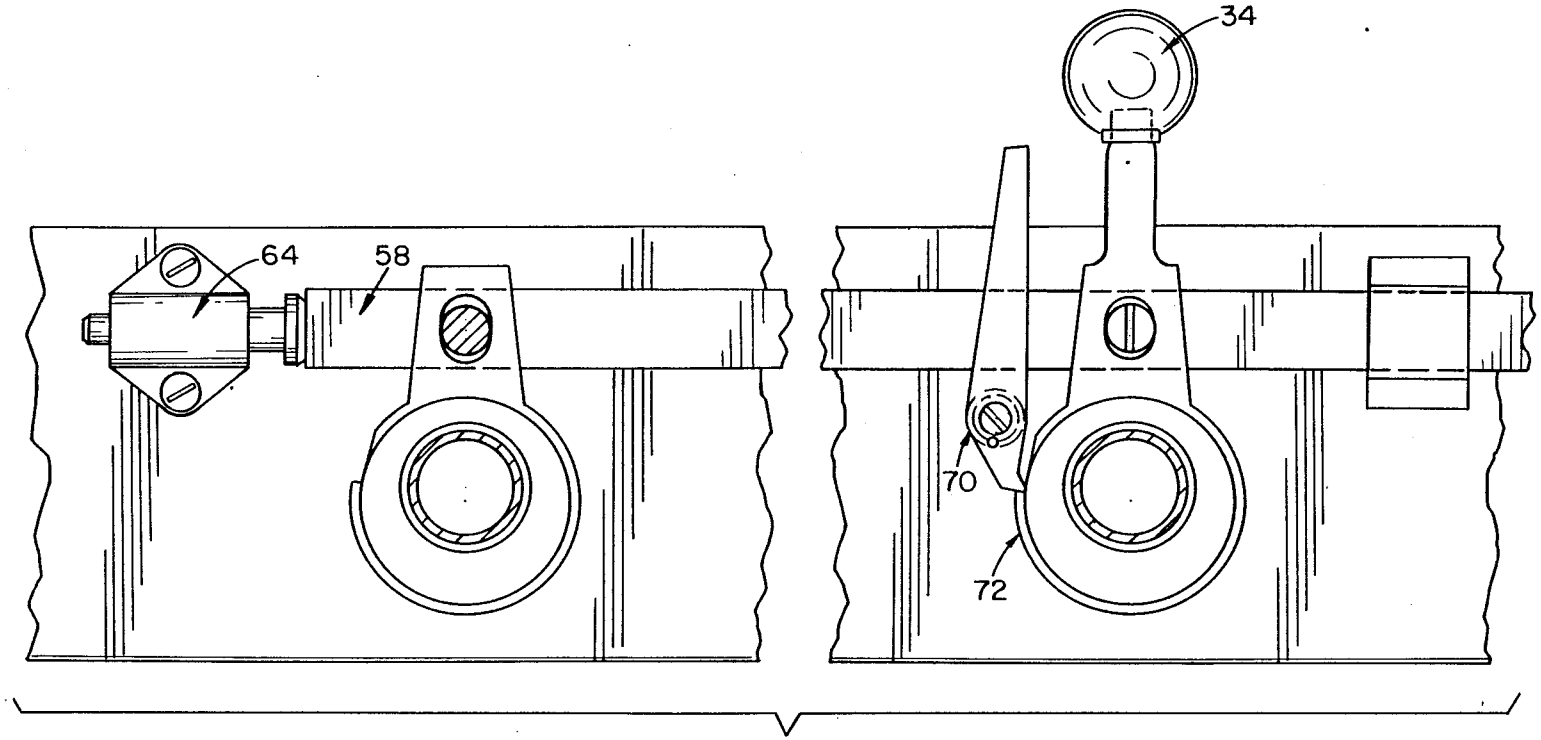
FIG. 3 is a bottom plan view taken along lines 3—3 of FIG. 2 of the adjustable frame member showing the biasing legs locks.

Turning now to FIG. 3 which shows a bottom plan view of the above discussed biasing legs, one may see that further locking is provided to the eccentric twist grip 56 of FIG. 2 through a latch 70. The latch 70 includes a torsion spring allowing the latch to slide along the outer circumference of an actuator plate 72 until reaching a notch whereby it adds an additional locking feature to the biasing legs lock 34.

Figure 4:
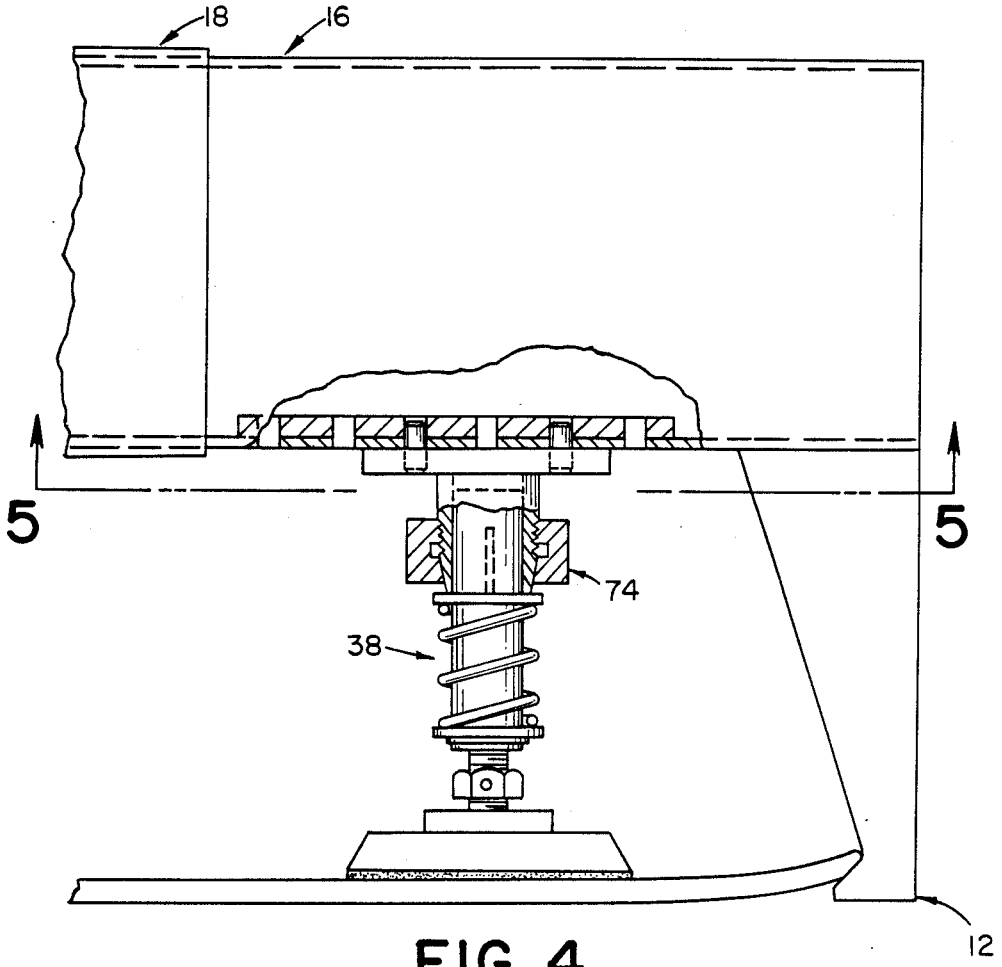
FIG. 4 is a side view of the tail end of the frame member with the biasing leg impinging upon the ski.
Figure 5:
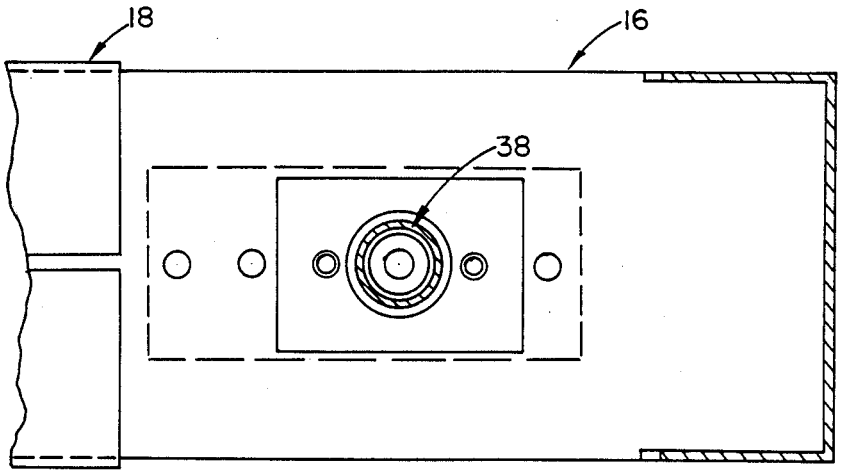
FIG. 5 is a top view of the frame member.

FIGS. 4 and 5 show the individual biasing leg 38 disposed at the tail of the flattened ski 2 wherein the tail of the ski closely abuts the rigid frame member 12 for secure retention therein. The above discussion concerning the biasing legs 30*a*–30*c* is generally applicable to the leg 38. A difference between the legs is that leg 38 has an individual eccentric twist grip lock typically actuated by a knurl type locking collar 74 for individually locking the leg 38. It is not actuated by the lever 34 and bar 58.

Figure 6:
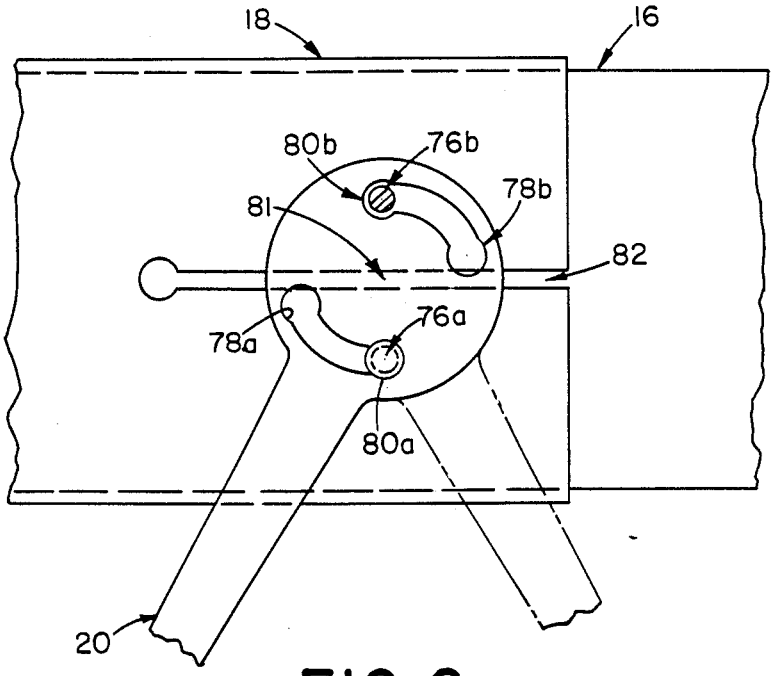
FIG. 6 is a view of the locking means for the selectively sizeable frame member.

As indicated above, the ski holding device 1 is sized for the ski 2 by telescoping the adjustable frame member 14. Specifically, after the tip of the ski has been engaged with the flexible strapping means 10, the inner portion of the frame 16 is slid into the mating outer portion 18 until the rigid member 12 engages the tail of the ski. Thereafter, the frame is locked into the set position. With reference to FIG. 6, this lock is be shown. After the desired length of the frame has been chosen, the frame is locked by throwing the frame lock lever 20. Upon movement of the lever 20, pins 76*a* and 76*b* received in lever arcuate slots 78*a*, 78*b* are urged either towards or away from each other due to the varying radius of the slots relative the point 81 of frame outer portion locking slot 82. Such movement in one direction forces the pins closer together thereby squeezing slot 82 closed and causing the inner wall of portion 18 to impinge upon the outer wall of portion 16 thereby locking the two telescoping pieces into position.

Figure 7:
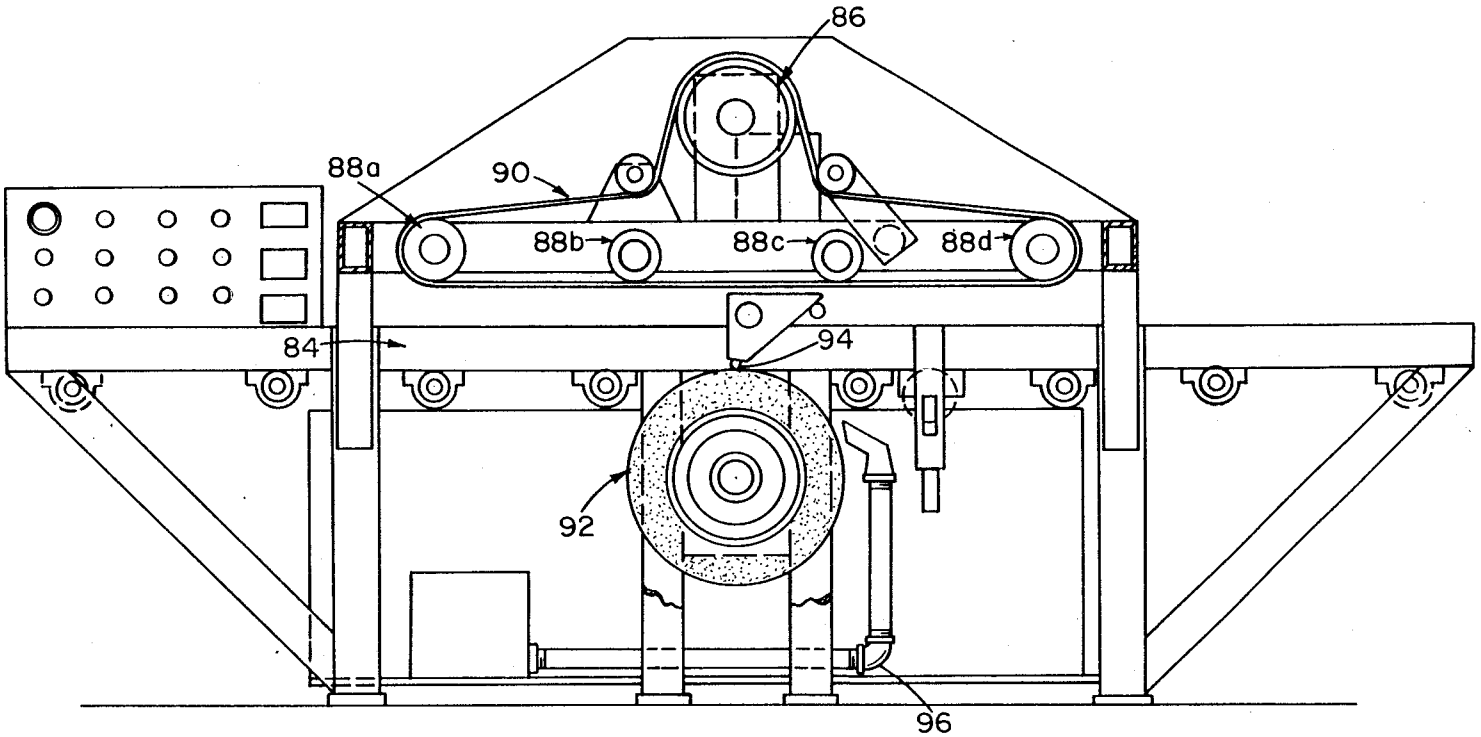
FIG. 7 is a generalized diagrammatical view of a grinder machine.

Turning now to FIG. 7, presented is a typical grinding machine which may make use of the present invention. A ski as shown in FIG. 1 may enter the machine through an opening 84. A feeder belt drive motor 86 causes drive wheels 88*a* through 88*d* to rotate, moving a drive belt 90. The frame of the ski holding device is engaged at the top by the drive belt thereby moving the ski through the grinding device. The bottom of the ski is ground by a grinding wheel 92. The grinding wheel is prepared by a wheel dresser 94, which is subsequently moved out of the ski's path. A coolant system 96 is provided for maintaining proper operating temperatures.

Figure 8:
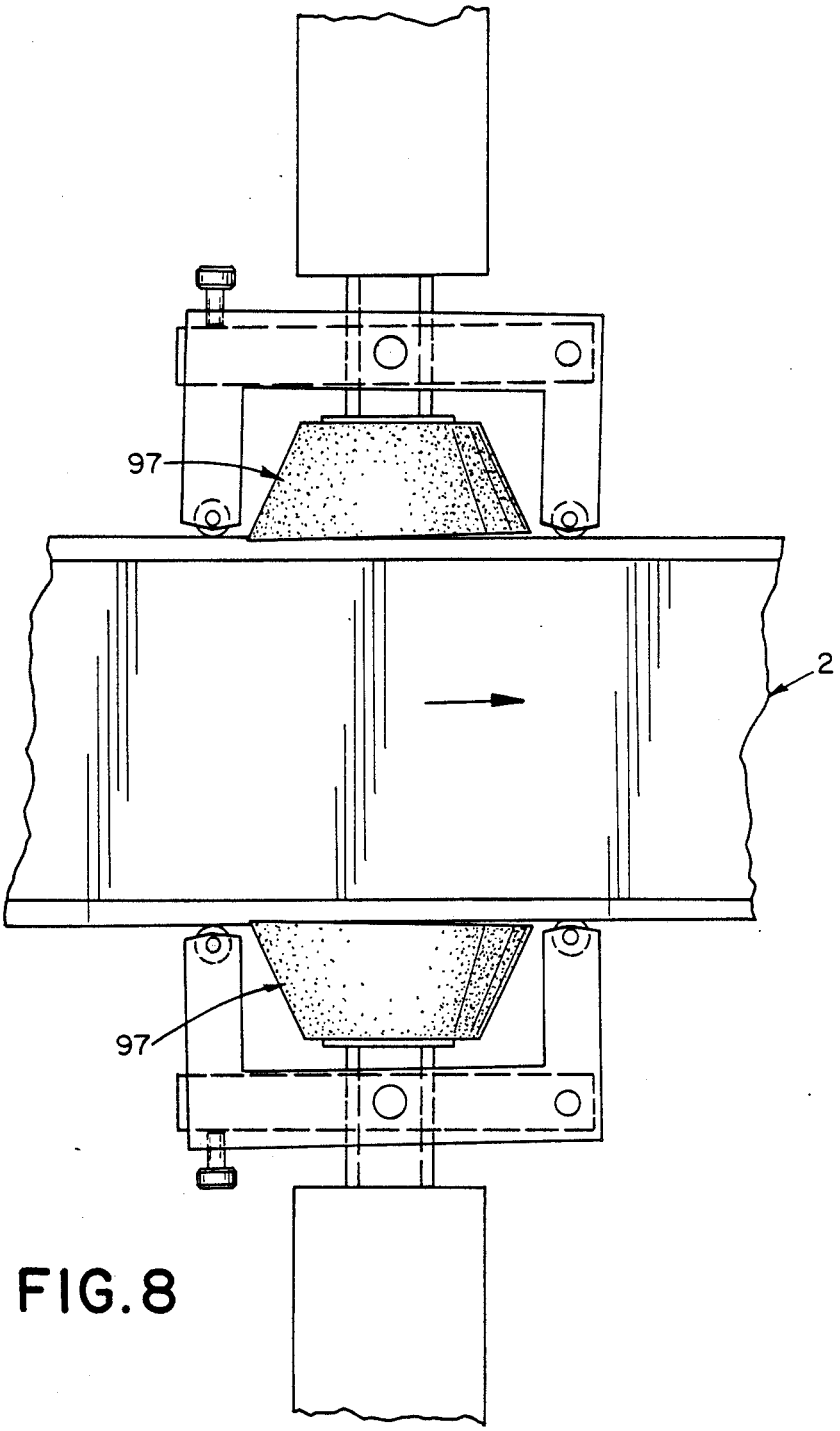
FIG. 8 is a view of the edging means contained within the overall grinder machine of FIG. 7; and, FIG. 9 is a simplified view of the present invention attached to the ski wherein the ski is further attached and clamped to a true straight edge.

FIG. 8 shows a ski 2, held by the present invention, going through the machine of FIG. 7. This FIGURE illustrates the method by which the machine resharpens the edges of the ski. The cup sanders 97 are positioned at a predetermined angular degree relative to the ski edge to allow the proper sharpness of the skis to be obtained. Proper placement of the ski to allow accurate re-edging is obtained through the use of the present invention by maintaining the ski in the predesired location without any substantial variation.

FIG. 9 shows a ski assembly in accordance with the present invention on a true straight edge 96 and clamped with clamps 98 thereto. Upon attachment of the frame to the ski feeler gauges may be used to test the straightness of the ski. If the ski as attached is not of the desired straightness adjustments may be made to the appropriate biasing leg to either increase or decrease the downward pressure being applied to the biasing leg. This increase or decrease in pressure is accomplished by movement of adjustment nut 52 as shown in FIG. 2. Upon a finding that the ski is of the desired straightness, the clamps are removed and the ski is ready to be ground.

A ski held in a fixture device of the present invention allows for improved and more accurate grinding of the ski running surface by maintaining the ski in a truly flattened state during grinding. The holder 1 will keep the ski camber from varying in-feed grinding while the essentially parallel frame portions 16, 18 to the ski running surface preclude scalloping that occurred where the grinding machine drive wheel had to travel over a ramp covering the bindings.

The ski held in the fixture device in the present invention allows the ski to be drawn over a flat bed or roller system and thereby insuring precise control of infeed by raising the grinding wheel or stone a predetermined height above the bed.

The invention has been described with reference to the preferred embodiment. Obviously, modifications and alterations will occur to others of ordinary skill in the art upon reading and understanding the preceding specification. It is intended that the invention be construed as including all such alterations and modifications in so far as they come within the scope of the appended claims or the equivalent thereof.

Having thus described the invention, it is now claimed:

1. A fixture for mounting onto a flattened ski for grinding by a grinding machine, the ski having a tail section, a top section, a longitudinal axis extending the length of the ski and a running surface, said fixture device comprising:

a longitudinally adjustable frame member selectively sizeable for fixed association with the ski said adjustable frame member being adjusted to maintain the ski in a flattened position;

a tail holding means for attaching the tail section of the ski to the adjustable frame member;

a tip holding means for attaching the tip section of the ski to the adjustable frame member; and, a plurality of biasing legs extending substantially transverse from the frame member to engage the ski and disposed to maintain the ski in the flattened position.

2. The fixture device as recited in claim 1 in which the adjustable frame member further includes frame lock for locking the adjustable frame member into a selected position.

3. The fixture device as claimed in claim 1 wherein the tip holding means comprises a flexible strap.

4. The fixture device as claimed in claim 1 wherein the tail holding means comprises a rigid portion of the frame member.

5. The fixture device as recited in claim 1 wherein the biasing legs are biased toward the ski by springs.

6. The fixture device as claimed in claim 1 wherein the biasing legs extending from the frame member to engage the ski include a leg locking means for locking the legs in a preselected biasing position.

7. The fixture device as claimed in claim 6 wherein the biasing legs further include expansion adjusters to selectively adjust the biasing pressure applied to the ski by the engagement of the biasing legs.

8. The fixture device as claimed in claim 6 wherein the locking means comprises an eccentric twist grip.

9. The fixture device as claimed in claim 8 wherein a plurality of the legs are commonly locked by a common actuator bar and lever assembly.

10. A method of flattening a ski and mounting the ski onto a fixture device, the ski having a tail section, a tip section, a longitudinal axis extending the length of the ski and a running surface, by setting the ski running surface as a registered surface said method comprising the steps of:

straightening the ski to remove a camber by putting the ski on a true straight edge and affixing the ski to the straight edge;

attaching the tail section of the ski to a tail holding means of the fixture device;

attaching the tip section of the ski to a tip holding means of the fixture device;

adjusting the length of the fixture device to produce a compression in the ski thereby maintaining the ski in a flattened position;

locking the fixture device to maintain the selected fixture device size and ski compression; and biasing the ski in the flattened condition relative to the fixture device by engaging the ski with a plurality of individually biasing legs selectively spaced in the fixture device whereby the ski running surface can be maintained flat and used as the registered surface when being ground by a grinding machine.

11. A method of varying the amount of engagement as recited in claim 10 wherein the varying of the amount of engagement is individually controllable for each biasing leg.

12. The method of flattening a ski as recited in claim 10 further including the step of:

detaching the ski from the straight edge to allow the ski running surface to be used as a register surface, whereby said method when used with a grinding machine allows for control of in-feed.

13. The method of biasing a ski in a flattened condition as recited in claim 10 further comprising:

varying the amount of engaging pressure between the ski and the biasing legs; and, locking the biasing legs to maintain the selected degree of engagement between the ski and the biasing legs.

14. The method of engaging as recited in claim 13 wherein the biasing legs will selectively engage the ski and ski bindings.

* * * * *